United States Patent [19]

Fontenot

[11] Patent Number: 4,883,046

[45] Date of Patent: Nov. 28, 1989

[54] INVOLUNTARY OSCILLATOR SYSTEM FOR THE MANDIBLE

[75] Inventor: Mark G. Fontenot, Lafayette, La.

[73] Assignee: Vitek, Inc., Houston, Tex.

[21] Appl. No.: 180,464

[22] Filed: Apr. 12, 1988

[51] Int. Cl.[4] ..... A61H 1/02

[52] U.S. Cl. ..... 128/25 R; 433/215; 272/95

[58] Field of Search ..... 433/215, 5, 24, 69, 433/6; 272/95, 94; 128/25 R, 12, 62 A, 76 R

[56] References Cited

U.S. PATENT DOCUMENTS

| | | | |
|---|---|---|---|
| 1,714,029 | 5/1929 | Kuhn | 272/95 |
| 2,061,936 | 11/1936 | Engelfried | 128/12 |
| 3,390,459 | 7/1968 | Seidenberg | 433/69 |
| 3,721,439 | 3/1973 | Rudolph et al. | 272/95 |
| 4,244,688 | 1/1981 | Kurz | 433/5 |
| 4,348,178 | 9/1982 | Kurz | 433/6 |
| 4,637,379 | 1/1987 | Saringer | 128/25 R |
| 4,700,695 | 10/1987 | Davis et al. | 128/25 R |

OTHER PUBLICATIONS

"An Appliance for Maxillo-Facial Mechanotherapy", Linet, Dental Cosmos, 1917, pp. 693-694.

*Primary Examiner*—John J. Wilson
*Attorney, Agent, or Firm*—Michael P. Breston

[57] ABSTRACT

The mandible oscillator system has an intraoral appliance mounted onto the upper and lower arches. A linear stepper motor forcibly imparts oscillating motion to the intraoral appliance. During one-half cycle of oscillation the lower arch is forced to move away from the upper arch, and during the other one-half cycle the lower arch is forced to move toward the upper arch. A programmable digital computer drives the motor and adjusts the parameters of the oscillating motion.

18 Claims, 3 Drawing Sheets

INVOLUNTARY OSCILLATOR SYSTEM FOR THE MANDIBLE

BACKGROUND OF THE INVENTION

1. Field of the Invention

This invention relates to an involuntary mandible oscillator system which forcibly opens and closes the lower jaw of the user for the purpose of rehabilitating abnormalities in and around the structure of the oral cavity.

2. Description of the Prior Art

A patient having temporomandibular joint ("TMJ") abnormalities in and around the structure of his oral cavity is asked to follow a rehabilitation regimen based on forcibly open and close his lower jaw. Such abnormalities may exist, for example, following arthroscopic procedures or TMJ reconstructive surgery.

The lower jaw forms part of the mandible. Jaw movement is the result of contraction of a group of muscles which perform their functions synergistically.

The mandibular elevators, which close the lower jaw, include the coordinated function of the masseter, temporal, and medial pterygoid muscles. The smooth and coordinated function of these muscles is essential for the proper occlusion of the teeth.

The mandibular depressors, which open the lower jaw, include the coordinated activity of the external pterygoid and the suprahyoid muscles. Protrusion of the mandible is performed by the masseter, internal pterygoid, and the external pterygoid muscles. Retrusion of the mandible is accomplished by the temporal an digastric muscles.

Soft tissue, e.g., scar tissue, cartilage, or any soft fibrous tissue, all hereinafter singularly or together called "tissue", can be described as a multiphasic structure consisting of cells, proteins, and proteoglycans entangled in a solid collagenous phase.

The proteoglycans swell in the presence of an electrolyte. The swelling pressure generated in the soft tissue is balanced by the tensile forces induced in the mesh of the collagen fibers in which the proteoglycans and cells are trapped. Movement of fluids into and out of the tissues is dependent on hydraulic permittivity and strain induced into the tissues.

Given a specific loading history imposed on a body of tissue, its physical properties will change dependent on the intensity of the applied loading and its direction. Tissue will change or remodel its volume, length, and mass from a reference structure to a new structure.

In particular, when a tensile strain history is imposed on tissue, the collagenous phase will remodel and align itself in a direction that is parallel to the principal direction of loading. In response to compressive loading, tissue remodels itself by increasing its proteoglycan content and aligns its collagenous phase in a plane perpendicular to the applied load.

Accordingly, loading can be directed and manipulated so as to accomplish specific therapeutic effects on the tissue. Thus, if properly administered, the involuntary total oscillation of the mandible, i.e., the automatic opening and closing of the mouth, following a prescribed rhythmic regimen, can induce strains within the oral tissue and surrounding structures that will result in enhanced healing and rapid pain reduction or suppression.

Such therapy will facilitate and accelerate the complete healing and rehabilitation of the tissue structures involved until the TMJ and the oral cavity are able to properly and adequately perform their various specific functions.

The rehabilitation process of the muscular structures of the oral cavity and of the TMJ, i.e., the actual muscle training and tissue healing, can be viewed as being voluntary, semi-voluntary, and involuntary.

A jaw exercising device, which is dependent solely on voluntary user participation, is described in U.S. Pat. No. 3,721,439. It is especially adapted for exercising the muscles of mastication in response to voluntary movement of the jaw by the user when biting upon a pair of intraoral, jaw-gripping plates. The voluntary jaw movement is resisted by a spring, hence inducing musculature development.

A mouth prop is described in U.S. Pat. No. 2,061,936. It is designed to prop open the jaws of a patient to gain access to the oral cavity with jaw-engaging bars that are spread apart by a threaded bolt on which a resilient coil spring is mounted. This prop has received wide acceptance for that purpose in the dental and medical professions.

In U.S. Pat. No. 4,700,695 is described a semi-voluntary system including an intraoral cam arrangement which is continuously driven by a motor for periodically opening (but not closing) the lower jaw.

This cam arrangement requires two intraoral cams, two maxillary tooth-engaging plates, two mandibular tooth-engaging plates, cam riding grooves within the mandibular plates, and a pair of cables for reciprocating both cams intraorally. The two intraoral cams, the two maxillary plates, the two mandibular tooth-engaging plates, and the pair of cables may require critical positioning, aligning and/or adjusting by an attendant in order to achieve proper bilateral jaw opening. Most importantly, this system assumes that the user's mandibular elevator muscles will voluntarily close the jaw.

But, when a user is under too much pain and swelling, he may be unable to voluntarily close the lower jaw, nor will his elevator muscles contract to close the mandibular jaw when they are under the influence of anesthetic agents or medication, or after they become detached during surgery. It normally takes about two to four weeks before the elevator muscles can regain their health or reattach to the mandible.

It is a primary object of this invention to provide a novel, totally involuntary jaw oscillator system, which is safe and substantially trouble-free, which allows a postoperative patient to administer to himself a prescribed continuous or intermittent motion protocol, in his home or hospital, thus avoiding dependence on an attendant for compliance with the protocol.

It is yet another object to provide a very effective, extraoral, electro-mechanical jaw oscillator system, which can be quickly and easily attached to and detached from the maxillary and mandibular jaws, and which is easily adapted for automatic operation under computer control.

SUMMARY OF THE INVENTION

The mandible oscillator system comprises upper and lower splints for releasably coupling to the user's upper and lower jaws, respectively. The upper and lower splints have upper and lower bars for releasably coupling to upper and lower motor arms, respectively. Oscillating means are coupled to the motor arms for forcibly oscillating the lower jaw within a predetermined angular range between a starting position and an end position, whereby during one-half cycle of oscillation the lower jaw is forced to move away from the upper jaw and during the other half-cycle the lower jaw is forced to move back toward the upper jaw. The operation is computer controlled and adjustable within prescribed functional ranges of mandibular motion.

DESCRIPTION OF PREFERRED EMBODIMENTS

Figure 1:
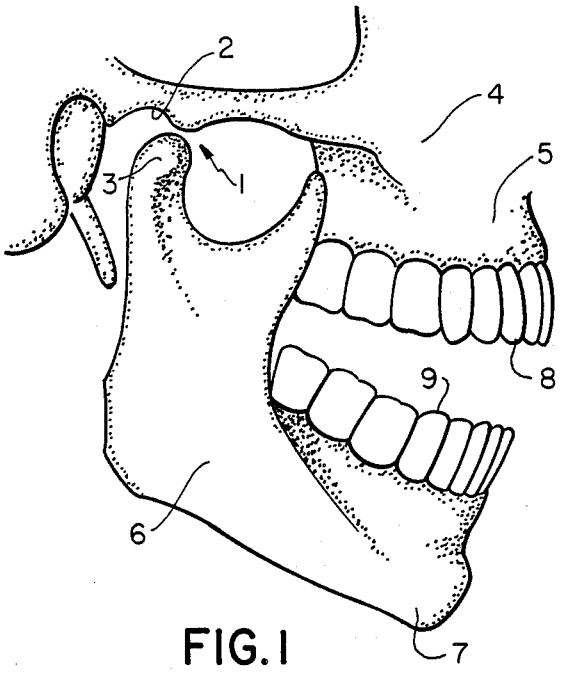
FIG. 1 is a side view in elevation of the oral cavity of a skeleton showing the right TMJ.

A normal TMJ 1 (FIG. 1) is a finely balanced hinge with a high degree of anatomical precision. It includes a glenoid fossa 2 and a condyle 3. The functionally unique feature of TMJ 1 is its unusual combination of a sliding movement and a hinge movement. The temporal bone 4 forms the glenoid fossa 2 and the maxillary or upper jaw 5. The mandibular bone 6 forms the condyle 3 and the lower jaw 7. There is a left TMJ and a right TMJ which move simultaneously when they are functionally intact. Functional integrity is related to the synchronism of the TMJ movements themselves, as well as to their interaction with surrounding tissue and muscular structures.

Mandibular jaw closure depends on functional integrity of a group of muscles which perform their functions simultaneously. The smooth functioning of these muscles is essential for the proper occlusion of the teeth. When these muscles and surrounding tissues are impaired due to injury or surgery, disclusion or malocclusion of the teeth often takes place.

Figure 8:
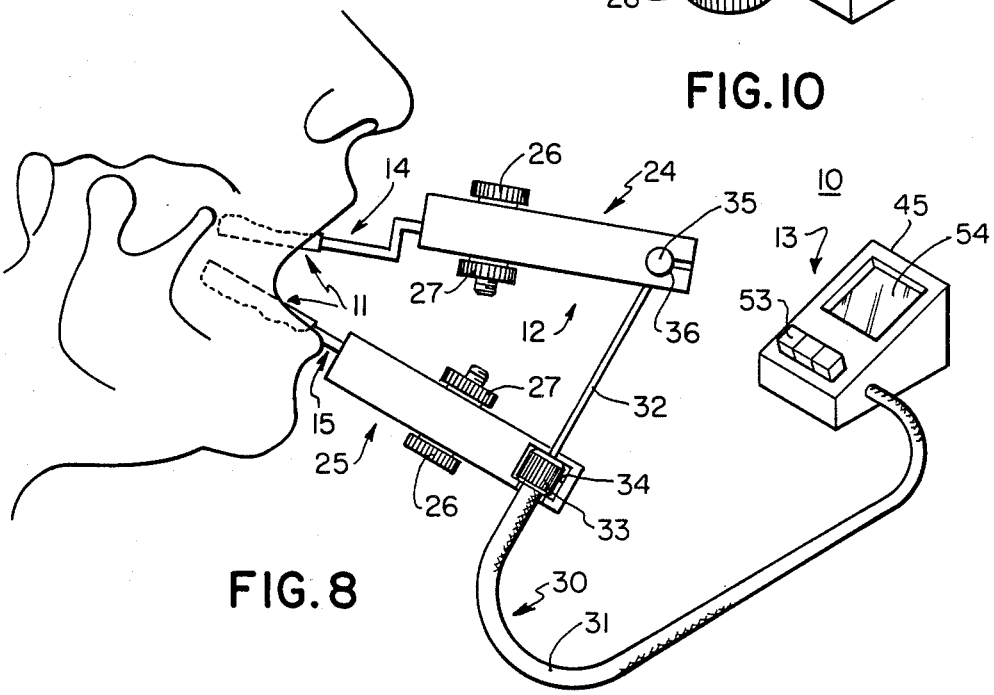
FIG. 8 is a side schematic view in elevation similar to FIG. 7 but showing the upper and lower jaws in their fully open mouth position.

The involuntary mandible oscillator system of this invention (FIGS. 1,8), generally designated as 10, is adapted to forcibly open and close lower jaw 7 of the user for the purpose of rehabilitating abnormalities which take place in and around the structure of the oral cavity. For example, such abnormalities exist after reconstructive TMJ or after severe injury inflicted to the TMJ.

The involuntary oscillating system 10 comprises an intraoral-extraoral appliance 11, a driven mechanism 12, and an electro-mechanical driver 13 for oscillating the driven mechanism 12 and appliance 11 coupled thereto.

Appliance 11 is adapted to become quickly and easily attached to and detached from the maxillary and mandibular teeth 8 and 9, respectively, without requiring critical positioning, aligning and adjusting by an attendant in order to achieve proper bilateral jaw action. Proper jaw opening and closing is achieved because of the symmetry of operation relative to a plane of symmetry containing the midlines of arches 5 and 7.

Appliance 11 preferably includes maxillary and mandibular splints 14 and 15, respectively.

Similar splint parts will be identically numbered to simplify the drawings.

Figure 2:
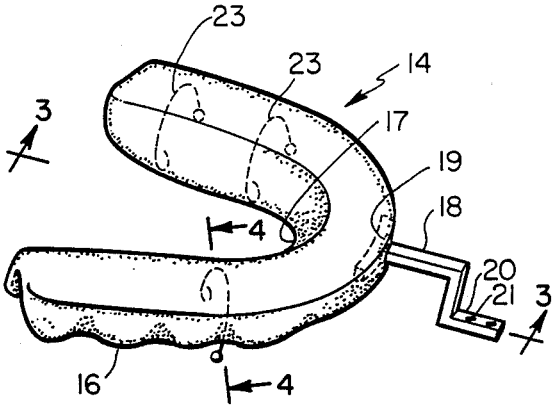
FIG. 2 is a perspective view of the maxillary splint for coupling the oscillator system to the teeth of the upper jaw.
Figure 3:
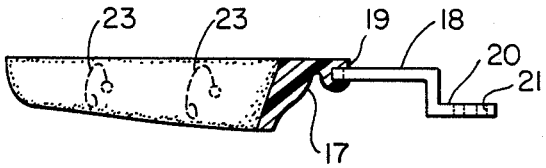
FIG. 3 is a sectional view on line 3—3 of FIG. 2.

Splint 14 (FIGS. 2-3) has a substantially U-shaped section 16 adapted to be releasably secured to the back teeth 8, and a shallow front section 17 coupled to front teeth 8. A Z-shaped bar 18 projects outwardly from the mouth in a plane containing the midline of arch 5. Bar 18 is coupled to the center 19 of section 17 and has an outer leg 20 with spaced transverse holes 21.

Figure 5:
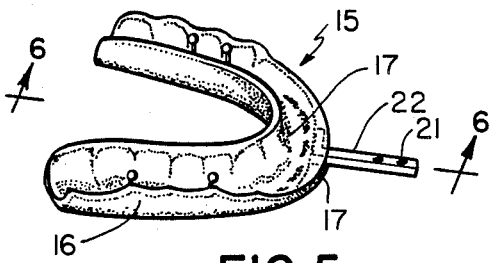
FIG. 5 is a perspective view of the mandibular splint for coupling the oscillator system to the teeth of the lower jaw.
Figure 6:
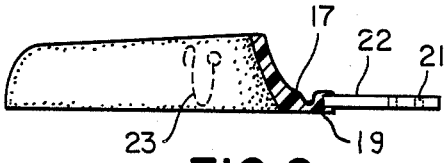
FIG. 6 is a sectional view on line 6—6 of FIG. 5.

Splint 15 (FIGS. 5-6) has a substantially U-shaped section 16 adapted to be releasably secured to the back teeth 9, and a shallow front section 17 coupled to front teeth 9. A straight bar 22 projects outwardly from the mouth in a plane containing the midline of arch 7. Bar 22 is coupled to the center 19 of section 17 and has spaced transverse holes 21.

Figure 4:
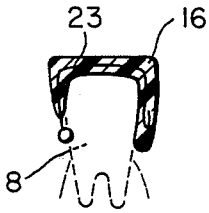
FIG. 4 is a sectional view on line 4—4 of FIG. 2.
Figure 7:
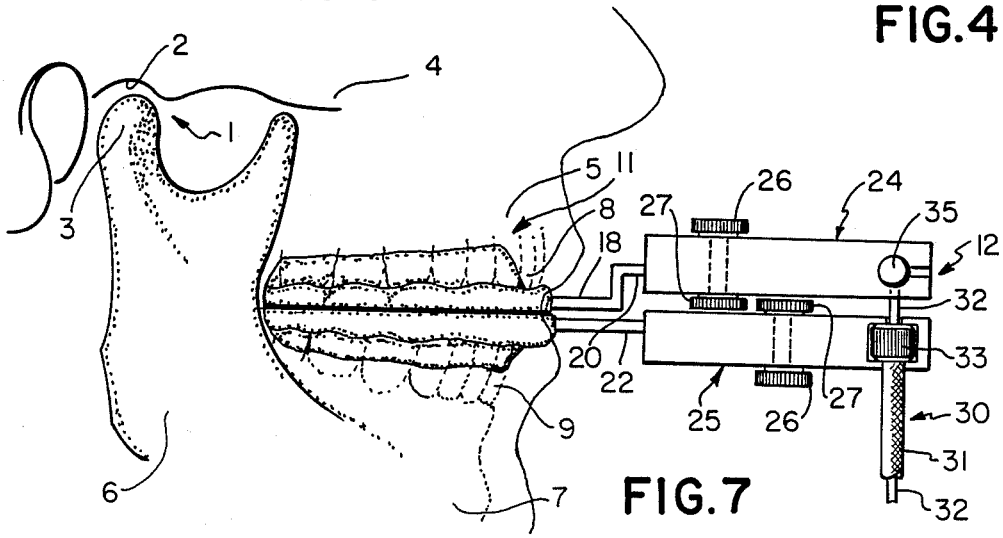
FIG. 7 is a side schematic view in elevation of an oral cavity showing the right TMJ and the motor arms coupled to the upper and lower splints shown in their closed mouth position.
Figure 11:
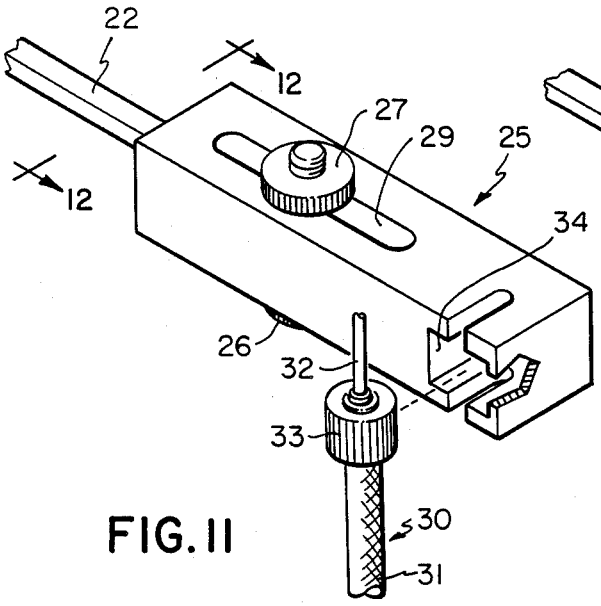
FIG. 11 is an exploded, perspective view showing the manner of coupling the sleeve of the push-pull cable and the bar of the lower splint to the lower motor arm.
Figure 9:
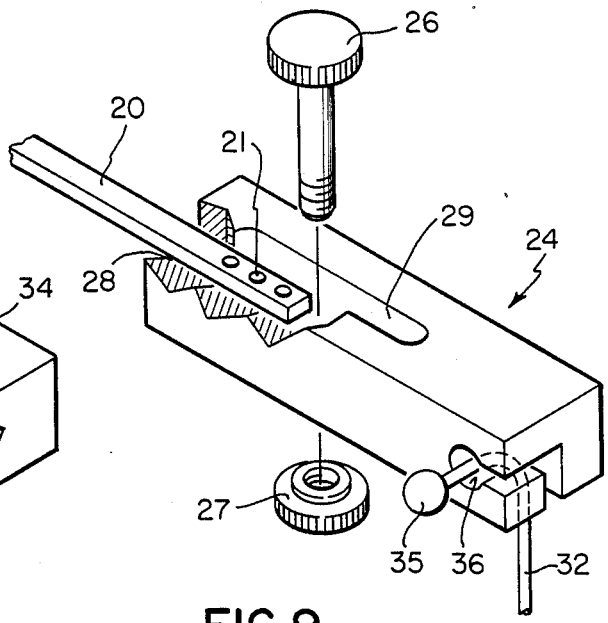
FIG. 9 is an exploded, perspective view showing the manner of coupling the flexible shaft of the push-pull cable and the bar of the upper splint to the opposite ends of the upper motor arm.
Figure 12:
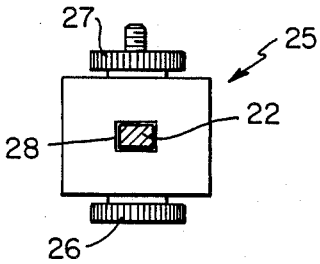
FIG. 12 is a side view on line 12—12 of FIG. 11.
Figure 10:
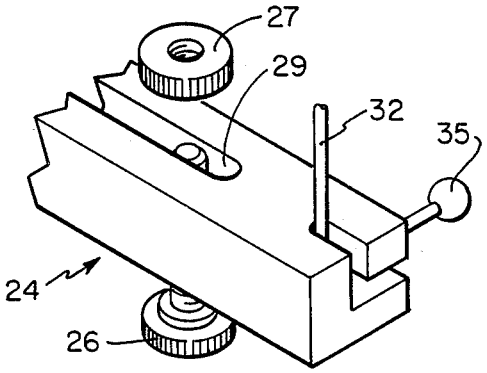
FIG. 10 is a fragmentary, exploded, perspective, upside down view of the upper motor arm.

Splint preparation is a routine dental procedure. Each splint is constructed of a resilient plastic that resiliently conforms to the patient's teeth and arches. For additional strength, each section 16 (FIG. 4) is reinforced with U-shaped stainless steel wires 23. The splints' resiliency allows them to snap on over their mating and assigned teeth, so that they can be quickly and easily attached to and detached therefrom.

The driven mechanism 12 (FIGS. 7-12) includes a maxillary motor arm 24 and a mandibular motor arm 25, in which similar elements will be identically numbered for the sake of simplicity, and a push-pull cable 30.

Maxillary bar 18 and mandibular bar 22 are releasably secured to motor arms 24 and 25, respectively, by screws 26 and nuts 27. An inner longitudinal channel 28 (FIG. 12) in each motor arm accepts the free end from its mating bar, as shown. Each screw 26 extends through a transverse longitudinal window 29 and through a selected hole 21 in a bar 18 or 22 within channel 28. Window 29 allows for longitudinal adjustment of the point of attachment between a splint bar and its mating motor arm, thereby effectively adjusting the length of the motor arm.

Thus, bars 18,22 extending from splints 14,15 are detachably coupled to motor arms 24,25, through which forces are applied to the user's teeth 8,9, respectively.

The electro-mechanical driver 13 (FIGS. 8,13) drives appliance 11 through the driven means 12 and push-pull cable 30. Push-pull cable 30 has a sleeve 31 and a flexible shaft 32. Sleeve 31 is removably anchored to motor arm 25 (FIG. 11) by means of a bushing 33 which snugly fits inside a chamber 34. Flexible shaft 32 (FIGS. 9-10) is removably anchored to motor arm 24 by means of a spherical or cylindrical pin 35 in a chamber 36.

Figure 13:
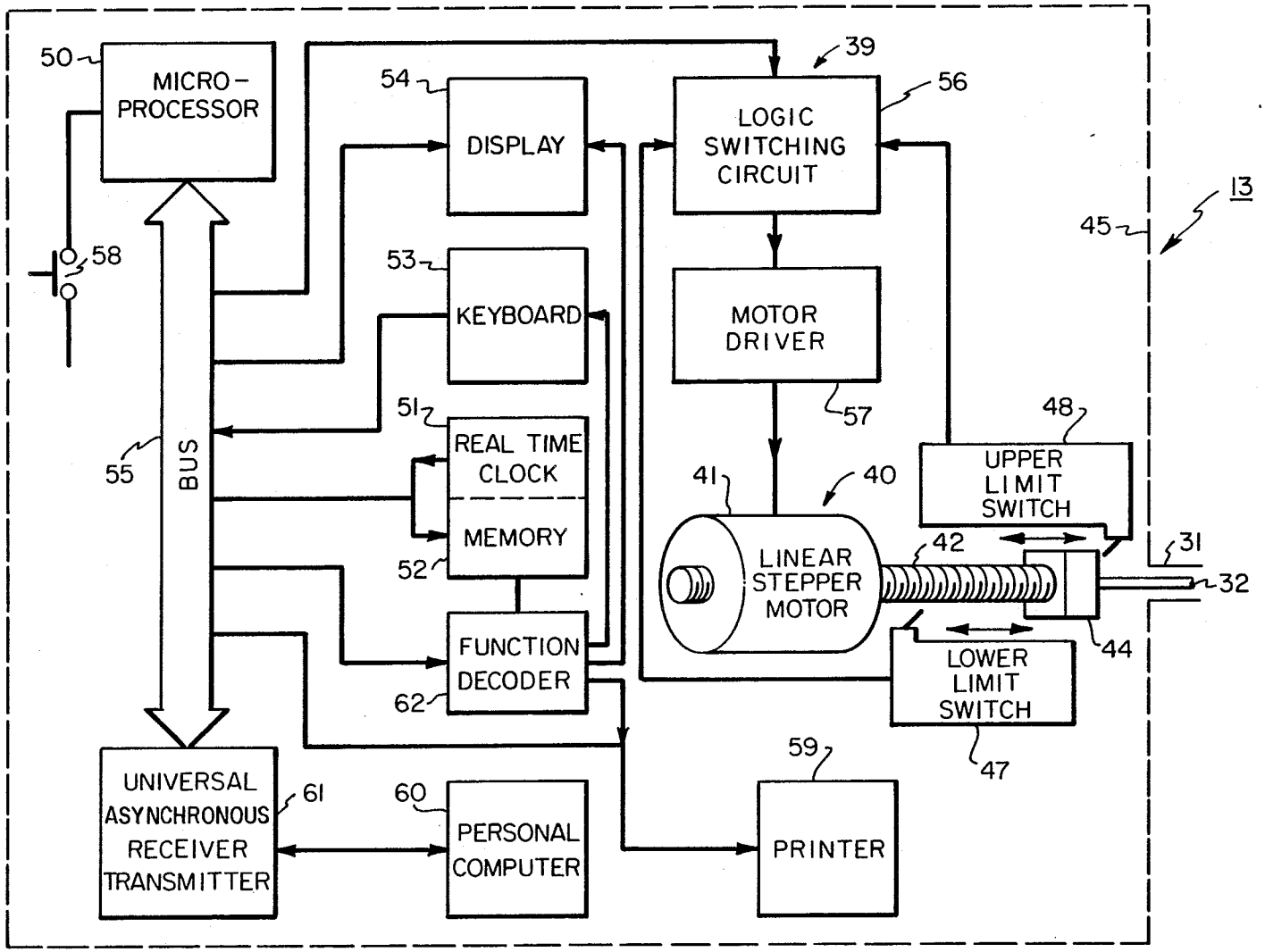
FIG. 13 is a block diagram of the electronic network which controls the stepper motor that operates the push-pull cable.

Mandibular motor arm 25, together with splint 15 coupled thereto, is made to pivot upwardly and downwardly relative to maxillary motor arm 24 by a computer-controlled linear driver 40 (FIG. 13).

In the preferred embodiment, driver 40 is a digital, rotary, 4-phase-stepper linear motor 41 having a hollow drive shaft 42 which can linearly move in either direction as shown by the arrows. The stepper motor 41 is mounted inside a chassis 45 containing an electronic network 39. The drive shaft 42 of motor 41 is coupled to the outer ends of motor arms 24 and 25 through push-pull cable 30. Motor 41 is required to exert relatively small forces between motor arms 24,25, which also beneficially serve as lever arms.

Flexible shaft 32 is coupled to drive shaft 42 through an insulating plastic coupler 44. Sleeve 31 surrounding shaft 32 is fixedly secured to chassis 45.

The motor's housing 41 is stationary and its drive shaft 42 can reciprocate linearly back and forth between an two desired points within a selected range having a displacement D, at a frequency F, and at an average speed V, thereby forcibly oscillating the lower jaw 7 within a predetermined angular range between a starting or closed mouth position and an end or open mouth position. During one-half cycle of oscillation, lower jaw 7 is forced to move away from upper jaw 5, and during the other half-cycle lower jaw 7 is forced to move toward upper jaw 5.

The parameters of frequency, displacement, and speed are interdependent.

Frequency F is the time it takes for the mouth to open and close. The user can select between eight frequencies F: 15, 30, 45, 60, 75, 90, 105 and 120 seconds/cycle.

The corresponding eight maximum linear displacements D of the motor's drive shaft 42 are: 19, 22, 25, 28, 31, 34, 37 and 40 millimeters per half cycle. In each half cycle lower jaw 7 pivots from closed, or approximately closed position, to open position within the allowed displacement, and in the other half cycle it moves back to its closed position.

During each half cycle, the average speed V is $V=2D/F$ hence the corresponding average speeds range from $V=2\times19/15=2.5$mm/sec to $V=2\times4O/1-2O=0.67$mm/sec.

The parameters were found to be within critical frequency, displacement, and speed ranges, as follows:

(a) frequency F from 15 through 120 seconds per full open/close cycle, (b) displacement D of the motor's drive shaft 42 from 20 through 40 millimeters per half cycle, and (c) average speed V of drive shaft 42 from 2.5 mm/sec through 0.67 mm/sec.

Motor 41 is under control of the electronic network 39 which includes a microprocessor 50 in conjunction with a real-time clock 51 and a random access memory chip 52.

The parameters of frequency F and displacement D, as well as the starting positions for drive shaft 42, are entered into memory 52 via a keyboard 53. Entered data is displayed on an L.C.D. display 54.

When mandible oscillator system 10 is started by a keyboard entry, microprocessor 50 retrieves the stored parameters from memory 52 via a common bus 55, converts the retrieved parameters to a given number of "steps", and sends these steps at the desired rate and direction through a logic switching circuit 56 into a motor driver 57. Driver 57 amplifies the stepping voltages to the levels necessary to run motor 41, which "steps" its drive shaft 42 in or out in 0.002 inch increments.

If a lower limit switch 47 is closed, indicating that lower splint 15 touches upper splint 14, logic circuit 56 will prevent further downward motion by stepper motor 41 and will send a signal to microprocessor 50 that splint 15 is in its "home" or reference position.

If an adjustable upper limit switch 48 is closed, indicating that splint 15 has opened further than the patient desired, then the stepping signals will be interrupted and an overriding signal will immediately step motor 41 back to its "home" position. Only by activating a manual reset switch 58 will the cycling operation resume.

The number of cycles which occur in a given therapy session are recorded in memory 52, together with the date and time derived from real time clock 51. The stored information can be printed out by a an optional printer 59.

A personal computer 60 may also be used to set one or more of the eight stepping frequencies F and to set one or more of the eight displacements D, which will then be available for the user to access from keyboard 53. The software used with the computer allows to easily change the entered parameter values.

The keyboard 53, display 54, clock 51, memory 52, printer 59, and a universal asynchronous receiver/transmitter (UART) 61 communicate through bus 55. A function decoder 62 allows microprocessor 50 to enable only that device with which it needs to communicate.

Network 39 operates on a supply of 24 volts DC, obtained from a wall mount transformer (not shown), which is divided into +11.0, 5.0, and −9.0 volts DC by a conventional voltage divider network.

The user can administer to himself a prescribed, continuous or intermittent motion protocol in his home as well as in the hospital, thus avoiding dependence on an attendant.

The user will experience rhythmic, mandibular movements designed to enhance healing and diminish or eliminate pain, swelling and edema, thereby facilitating and accelerating the healing and rehabilitation of the oral cavity to the point that it can properly and adequately perform its various functions.

These rhythmic movements are involuntary, i.e., the user does not need to assist or resist them.

Network 39 is adapted to administer to the oral tissue and TMJ a physiological loading history to which tissue responds by remodeling its physical properties.

Tissue will change or remodel its volume, length and mass from a reference structure to a new structure in response to the total specific loading history imposed on that tissue.

The loading is selected so as to accomplish the desired and beneficial tissue changes, to maximize the strength of the tissue structures and of the musculature of mastication in and around the TMJ.

Some of the units in electronic network 39 are identified and can be purchased from the following suppliers:

| UNIT | No. | Vendor |
|---|---|---|
| 50 | MC68705 | Motorola |
| 61 | | Motorola |
| 62 | | Motorola |
| 56 | | Motorola |
| 57 | | Airpax |
| 41 | | Airpax |

-continued

| UNIT | No. | Vendor |
|---|---|---|
| 51 | MK48T02 | |

What I claim is:

1. A mandible oscillator system, comprising:

an appliance having upper and lower intraoral portions for respectively mounting onto the upper and lower arches of a user, said upper and lower intraoral portions having, respectively, upper and lower extraoral extensions which coincide approximately with the midlines of said upper and lower arches;

upper and lower motor arms respectively releasably secured to said upper and lower extraoral extensions;

extraoral oscillating means including:

(a) motor means, including a linear stepper motor coupled between the outer ends of said motor arms for forcibly imparting oscillating motion to the outer end of said lower motor arm relative to the upper end of said upper motor arm, between predetermined start and end positions, within a predetermined angular range, and at a predetermined frequency and average velocity, whereby during one-half cycle of oscillation said lower arch is forced to move away from said upper arch, and during the other one-half cycle said lower arch is forced to move toward said upper arch, thereby forcefully imposing on said user rhythmic mandibular movements;

(b) programmable digital computer driver means for driving said motor; and (c) electronic control means coupled to said driver means for adjusting said frequency, angular range, and average velocity of said oscillating motion.

2. The mandible oscillator systems according to claim 1, wherein said relative average velocity of said outer ends of said motor arms is between 2.5 mm/sec and 0.67 mm/second.

3. The mandible oscillator system according to claim 2, wherein the relative displacement of said motor arms is between 15 mm to 40 mm of intercisal opening.

4. The mandible oscillator system according to claim 3, wherein the frequency of oscillation is between 15 to 120 seconds per cycle, and said frequency is the time from minimum intercisal opening to maximum opening and back to minimum opening in one cycle of oscillation.

5. The mandible oscillator system according to claim 4, wherein said stepper motor is a rotary stepper 4-phase motor; and said motor means includes a push-pull cable coupled between the shaft of said motor and said outer ends of said motor arms.

6. The mandible oscillator system according to claim 1, wherein said stepper motor is a rotary stepper 4-phase motor; and said motor means includes a push-pull cable coupled between the shaft of said motor and said outer ends of said motor arms.

7. A mandible oscillator system, comprising:

an appliance having upper and lower intraoral portions for respectively transmitting forces to the upper and lower arches of a user;

means including extraoral upper and lower motor arms respectively coupled to said upper and lower intraoral portions; and extraoral motor means coupled to said motor arms for oscillating said lower motor arm relative to said upper motor arm without requiring the assistance from the muscles of said user.

8. The mandible oscillator system according to claim 7, wherein, said upper and lower intraoral portions having, respectively, upper and lower extraoral extension which coincide approximately with the midlines of said arches; and said upper and lower motor arms respectively attaching to said upper and lower extensions.

9. The mandible oscillator system according to claim 8, wherein, said motor means includes a linear stepper motor.

10. The mandible oscillator system according to claim 8, wherein, said motor means includes a linear stepper motor coupled between the outer ends of said motor arms for forcibly imparting oscillating motion to the outer end of said lower motor arm relative to the upper end of said upper motor arm between predetermined start and end positions, within a predetermined angular range, and at a predetermined, frequency and average velocity, whereby during one-half cycle of oscillation said lower arch is forced to move away from said upper arch, and during the other one-half cycle said lower arch is forced to move toward said upper arch, thereby forcefully imposing on said user rhythmic mandibular movements.

11. The mandible oscillator system according to claim 10, and programmable digital computer driver means for driving said motor; and electronic control means coupled to said driver means for adjusting said frequency, angular range, and average velocity of said oscillating motion.

12. The mandible oscillator system according to claim 11, wherein, the relative average velocity of said outer ends of said motor arms is between 2.5 mm/sec and 0.67 mm/second.

13. The mandible oscillator system according to claim 12, wherein, said stepper motor is a rotary stepper 4-phase motor; and said motor means includes a push-pull cable coupled between the shaft of said motor and said outer ends of said motor arms.

14. The mandible oscillator system according to claim 7, wherein, said motor means includes a linear stepper motor.

15. A mandible oscillator system adapted to forcefully impose on a user rhythmic mandibular movements, comprising:

an upper splint having a first portion adapted to be releasably secured to a user's upper arch and having a second portion which extends extraorally so as to coincide approximately with the midline of said upper arch;

a lower splint having a third potion adapted to be releasably secured to said user's lower arch and having a fourth portion which extends extraorally so as to coincide approximately with the midline of said lower arch;

said second and fourth portions being vertically spaced apart;

an upper motor arm releasably secured to said second portion;

a lower motor arm releasably secured to said fourth portion; and oscillating means including motor means coupled to the outer ends of said motor arms for imparting oscillating motion to said lower motor arm and to said lower arch coupled thereto relative to said upper arch, thereby forcibly oscillating the lower arch within a predetermined angular range between a start position and an end position, whereby during one-half cycle of oscillation the lower arch is forced to move away from the upper arch, and during the other half-cycle the lower arch is forced to move toward the upper arch.

16. The mandible oscillator system according to claim 15, wherein said motor means includes a linear stepper motor.

17. The mandible oscillator system according to claim 16, wherein the average speed of the motor's shaft is between 2.5 mm/sec and 0.67 mm/second, the frequency of oscillation is from 15 through 120 sec/cycle, and the displacements of the motor's shaft are from 20 through 40 millimeters per half cycle.

18. A mandible oscillator system, comprising:

an appliance having upper and lower intraoral portions for respectively attaching to the upper and lower arches of a user, said upper and lower intraoral portions having, respectively, upper and lower extraoral extensions which coincide approximately with the midlines of said upper and lower arches;

upper and lower motor arms for respectively attaching to said upper and lower extensions;

a cable having a sleeve and a flexible drive shaft extending therethrough;

said shaft being anchored to the outer end of one of said motor arms;

said sleeve being anchored to the outer end of the other of said motor arms; and oscillating means including a linear stepper motor having a motor shaft coupled to said flexible shaft and to said sleeve for oscillating said lower motor arm relative to said upper motor arm between predetermined start and end positions and at a predetermined displacement, frequency, and average speed, whereby said lower arch is reciprocatingly forced to move away from and toward said upper arch.

* * * * *